US008157426B2

(12) United States Patent
Ginsburg et al.

(10) Patent No.: US 8,157,426 B2
(45) Date of Patent: Apr. 17, 2012

(54) HIGH MAST LIGHTING SYSTEM WINCH ASSEMBLY

(75) Inventors: Thomas Ginsburg, Saginaw, TX (US); Scott Engberg, Dallas, TX (US)

(73) Assignee: CHM Industries, Inc., Saginaw, TX (US)

( * ) Notice: Subject to any disclaimer, the term of this patent is extended or adjusted under 35 U.S.C. 154(b) by 566 days.

(21) Appl. No.: 12/252,906

(22) Filed: Oct. 16, 2008

(65) Prior Publication Data

US 2010/0097813 A1 Apr. 22, 2010

(51) Int. Cl.
*F21V 21/36* (2006.01)

(52) U.S. Cl. ..... 362/431; 362/403; 362/386

(58) Field of Classification Search ..... 362/285, 362/386, 403, 418, 431, 382; 248/320, 323, 248/327; 52/745.17
See application file for complete search history.

(56) References Cited

U.S. PATENT DOCUMENTS

| | | | | | |
|---|---|---|---|---|---|
| 3,911,267 | A | * | 10/1975 | Kiehn | 362/282 |
| 4,025,782 | A | * | 5/1977 | Kaeser | 362/403 |
| 4,851,980 | A | * | 7/1989 | McWilliams et al. | 362/403 |
| 5,031,085 | A | * | 7/1991 | Rustin | 362/401 |
| 5,400,019 | A | * | 3/1995 | Riscoe, Jr. | 340/908 |

* cited by examiner

*Primary Examiner* — Thomas Sember
(74) *Attorney, Agent, or Firm* — Gardere Wynne Sewell LLP

(57) ABSTRACT

A high mast lighting system, comprising a mast, a pole plate disposed within the mast and a winch assembly coupled to the pole plate, wherein at least a portion of the winch assembly extends through an opening in the pole plate.

12 Claims, 5 Drawing Sheets

HIGH MAST LIGHTING SYSTEM WINCH ASSEMBLY

BACKGROUND

High mast lighting systems include a central mast or pole surrounded by an annular ring on which a plurality of light fixtures are mounted. The annular ring is configured to be raised to the top of the mast for use and lowered to the base of the mast during maintenance and lamp changes. A drive device, located at the base of the mast, raises and lowers the annular ring via a plurality of winch cables, which pass downwardly from pulleys on top of the mast to the drive device.

However, due to limited space inside the mast, the winch cables can block or otherwise impede access to various operating equipment therein. For example, winch cables oftentimes impede access to circuit breaker boxes. In many instances, a service technician must physically move the winch cable laterally away from the breaker box in order to gain access thereto. Since the weight of the annular ring and light fixtures creates large tension forces on the winch cables, laterally moving the winch cables can be difficult.

DETAILED DESCRIPTION

Figure 1:
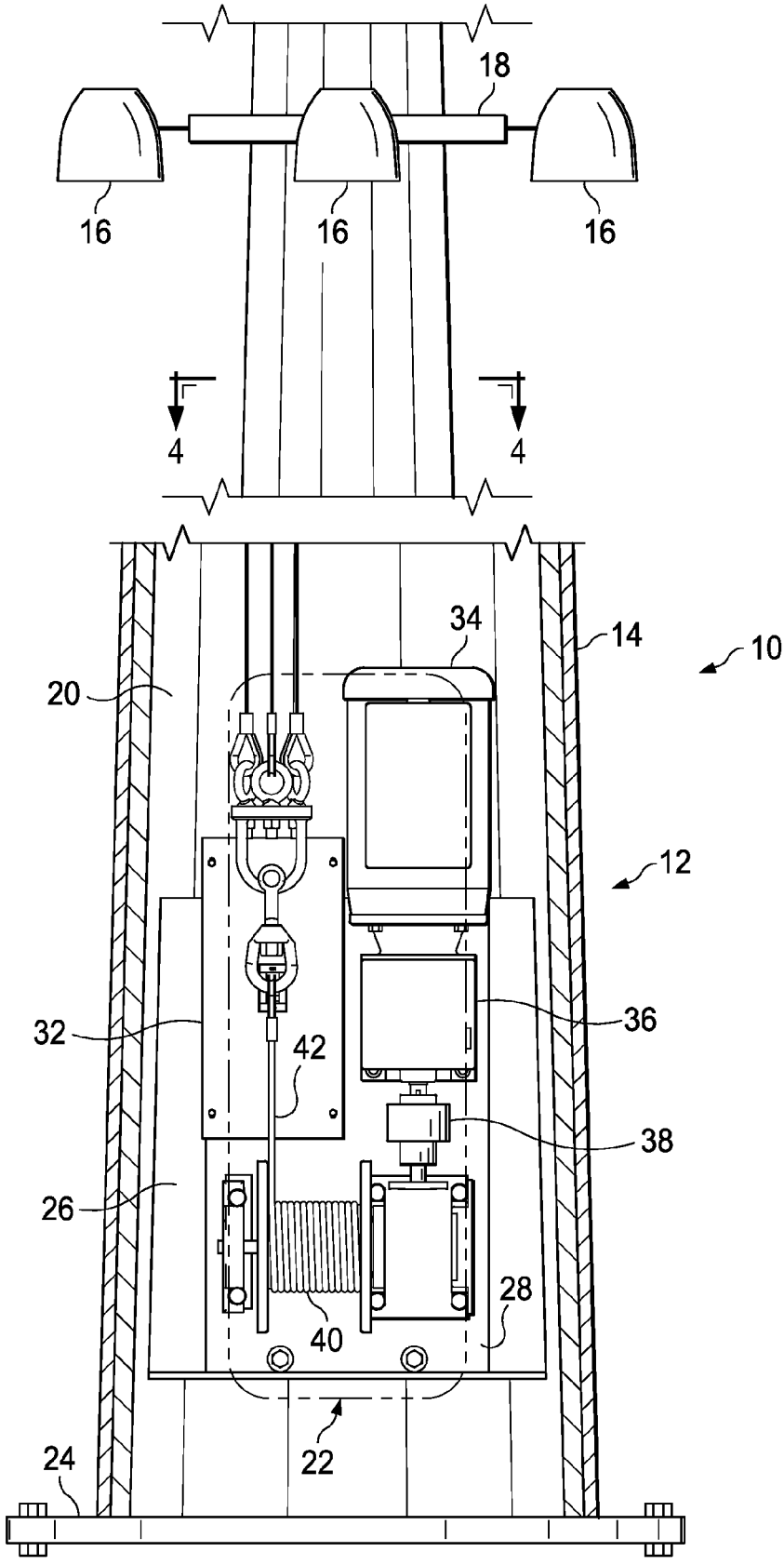
FIG. 1 is an illustration of a high mast lighting system in which a recessed winch assembly is employed to advantage.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Figure 2:
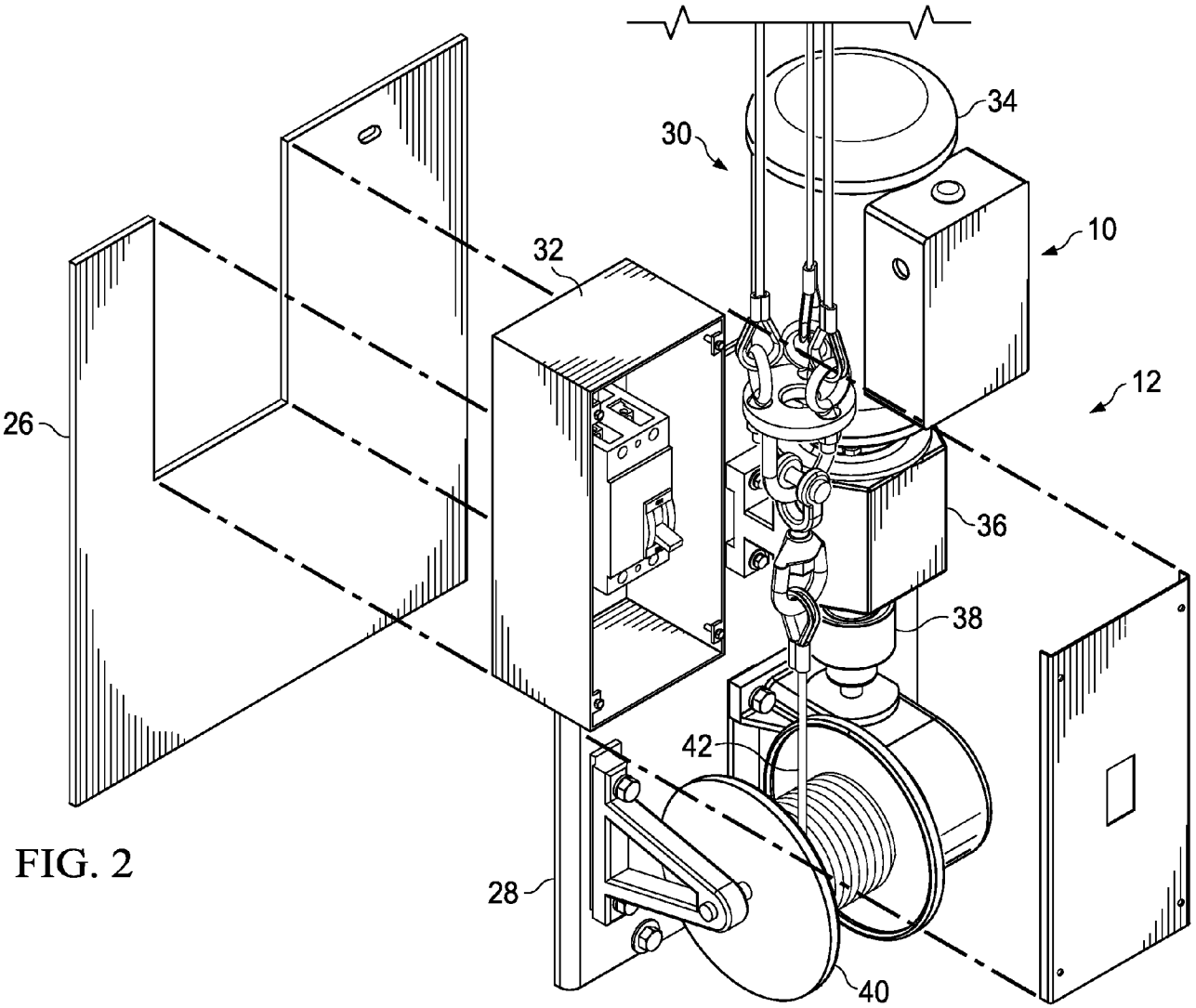
FIG. 2 is an exploded perspective view illustrating the winch assembly of FIG. 1.

FIGS. 1 and 2 are diagrams illustrating a high mast lighting system 10 in which a recessed winch assembly 12 is employed to advantage. In FIG. 1, high mast lighting system 10 comprises a generally elongated hollow support mast 14 formed of steel, aluminum, or the like, for supporting a plurality of light fixtures 16 mounted on an annular support ring 18. The support ring 18 is raised during use and lowered for maintenance of light fixtures 16 via winch assembly 12. In the embodiment illustrated in FIG. 1, winch assembly 12 is disposed within the interior 20 of mast 14 and is accessible via hand hole 22 located generally near base 24 of mast 14.

In FIGS. 1 and 2, winch assembly 12 is secured to and otherwise supported within mast 14 via a pole plate 26. In the embodiment illustrated in FIGS. 1 and 2, winch assembly 12 includes a winch plate 28 for supporting and coupling a drive system 30 to pole plate 28, and a circuit breaker box 32. According to some embodiments, drive system 30 includes a motor 34, a gear reduction mechanism 36 (best seen FIG. 1) and a torque limiting device 38 (best seen in FIG. 1), all configured to rotate a spool 40 for winding and unwinding a cable 42 and thus, raising and lowering support ring 18. In FIGS. 1 and 2, circuit breaker box 32 is integrally formed and/or otherwise welded to winch plate 28; however, it should be understood that circuit breaker box 32 may be removably coupleable to winch plate 28 by mechanical fasteners or an adhesive. When it is desired to lower support ring 18 and/or otherwise service/replace one or more light fixtures 16, a cover (not illustrated) is removed from hand hole 22 to provide access to winch assembly 12.

Figure 3A:
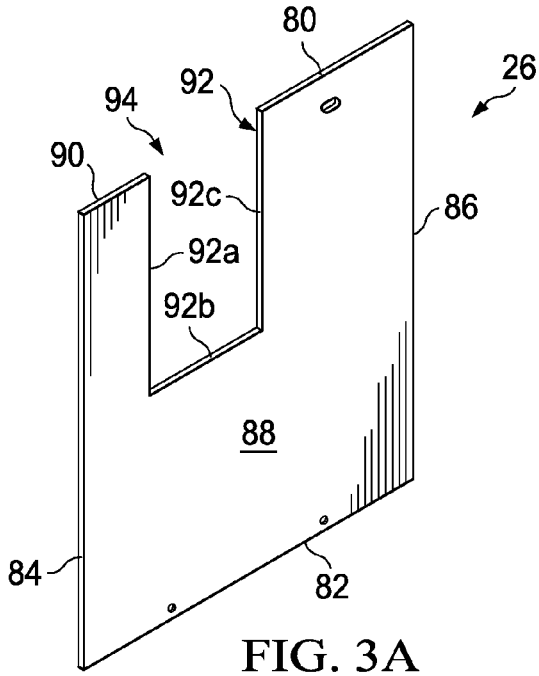
FIGS. 3A-3C are diagrams illustrating a pole plate for supporting the winch assembly of FIGS. 1 and 2.
Figure 3B:
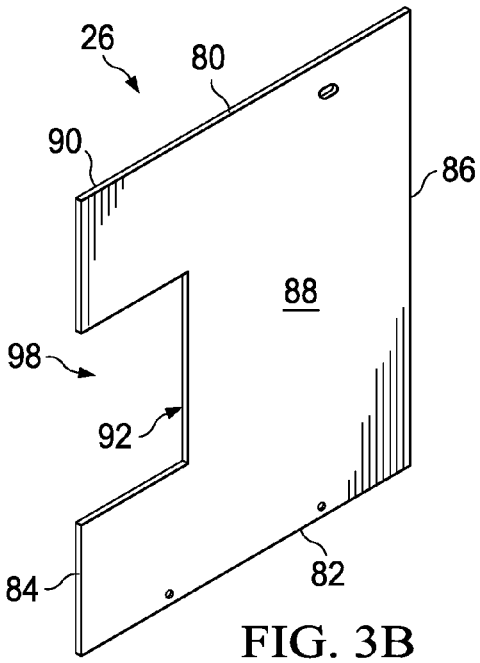
Figure 3C:
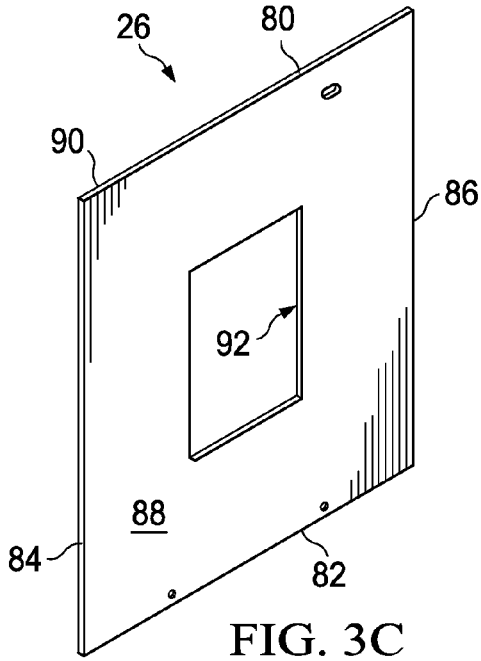

FIGS. 3A-3C are diagrams illustrating pole plate 26 for supporting winch assembly 12 of FIGS. 1 and 2. In the embodiment illustrated in FIG. 3*a*, pole plate 26 comprises top edge 80, a bottom edge 82 and a pair of side edges 84 and 86 forming a front surface 88 and an opposed rear surface 90. Pole plate 26 comprises an opening 92 extending between front and rear surfaces 88 and 90 and is sized to receive at least a portion of winch assembly 12. In the embodiment illustrated in FIG. 3A, opening 92 is formed by edges 92*a*, 92*b* and 92*c* and includes open top portion 94 adjacent top edge 80; however, it should be understood that opening 92 may be otherwise positioned on pole plate 26, such as, for example, having an open side portion 98 (FIG. 3B) adjacent edge 84, or having an opening 92 generally centered or positioned within the interior of pole plate 28 (FIG. 3C).

Figure 4:
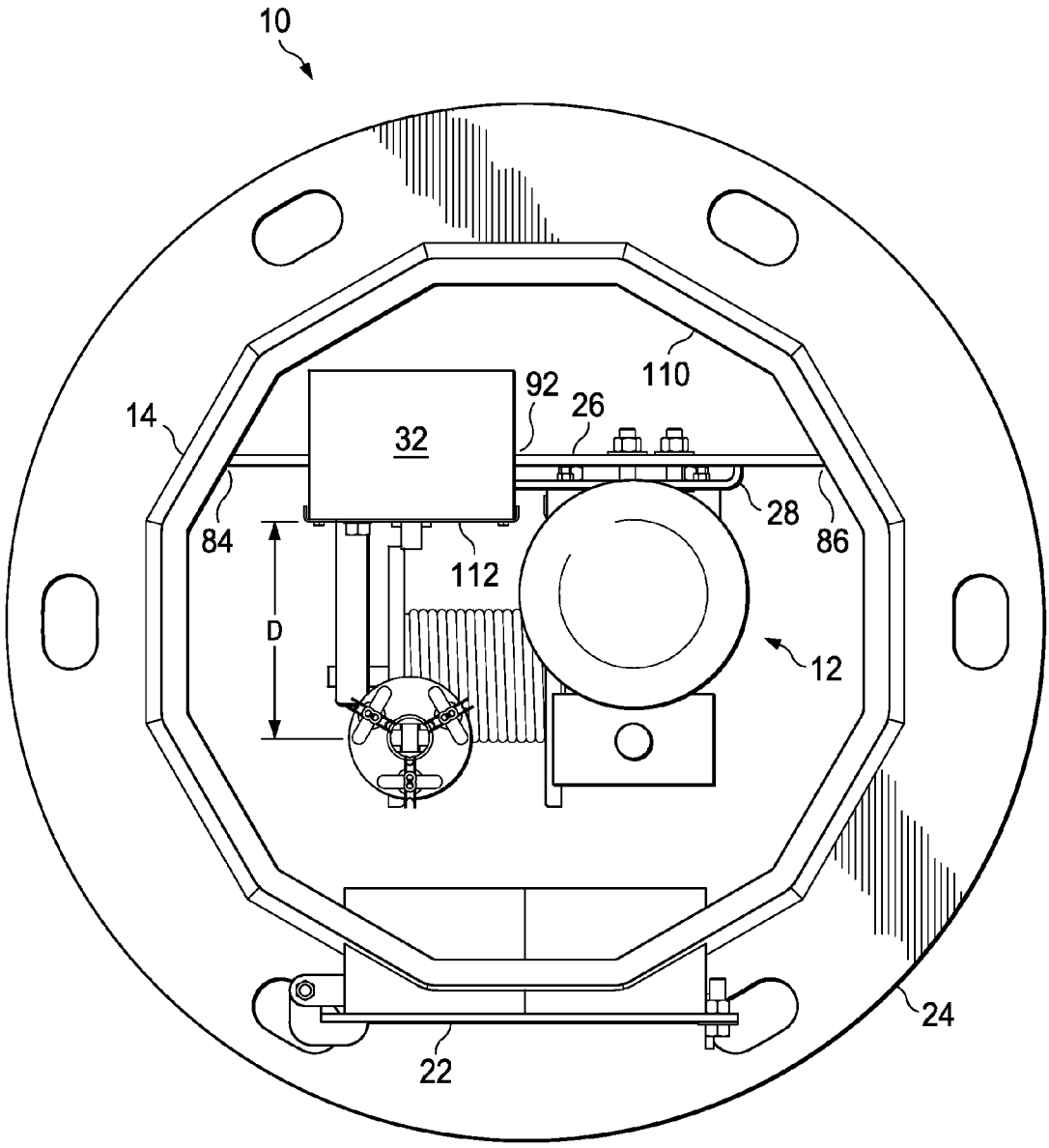
FIG. 4 is a section view taken along line 4-4 of FIG. 1 illustrating the winch assembly.
Figure 5:
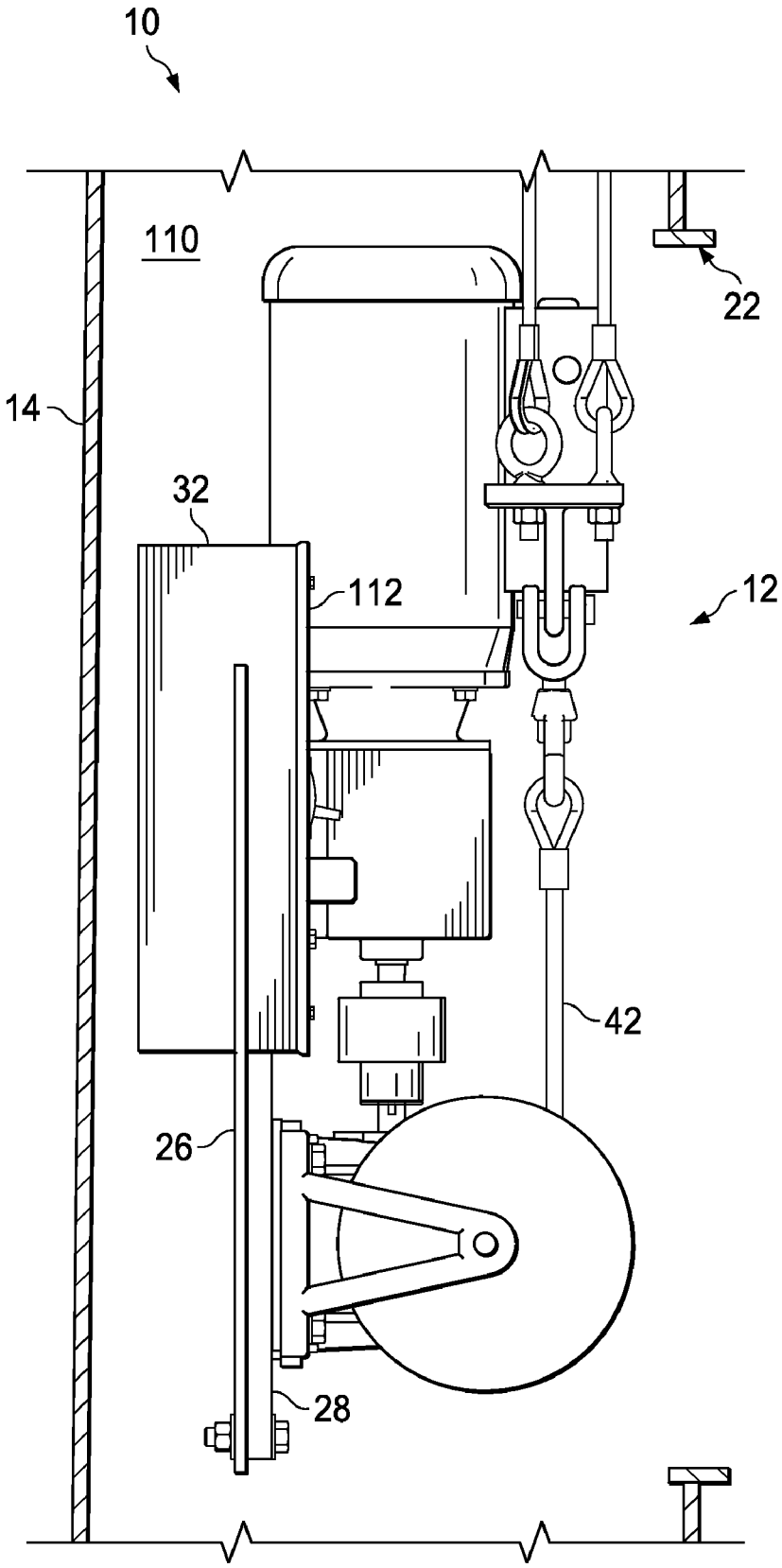
FIG. 5 is a side view of the recessed winch assembly of FIGS. 1 and 2.

FIG. 4 is a section view taken along line 4-4 of FIG. 1 and FIG. 5 is a side view of winch assembly 12. In the embodiment illustrated in FIGS. 4 and 5, pole plate 26 is disposed within mast 14 such that edges 84 and 86 contact and are otherwise coupled an interior wall 110 of mast 14. According to some embodiments, pole plate 26 is secured to interior wall 110 by welding, an adhesive, mechanical fasteners or otherwise so as to support winch assembly 12 in general alignment with hand hole 22.

In FIGS. 4 and 5, winch assembly 12 is secured to pole plate 26 such that circuit breaker box 32 is at least partially disposed within opening 92 (FIG. 3A) of pole plate 26. For example, in the embodiment illustrated in FIGS. 4 and 5, winch plate 28 is secured to front surface 88 of pole plate 26 to enable circuit breaker box 32 to extend laterally through opening 92 and beyond rear surface 90. Accordingly, opening 92 enables at least a portion of circuit breaker box 32 to be recessed or otherwise offset relative to winch plate 28 such that as winch pate 28 is secured to front surface 88 of pole plate 26, breaker box 32 is offset so as to enable a greater distance D (FIG. 4) between a cover or door 112 of circuit breaker box 32 and winch cable 42. Thus, easy access to breaker box 32 is facilitated without obstructions from cable 42 and/or otherwise requiring a person accessing breaker box 32 to manually move winch cable 42 away from alignment with breaker box 32. For example, in the event a service technician is required to access the interior of breaker box 32, the technician may easily open and/or otherwise remove cover 112 of breaker box 32 to facilitate access thereto with little or not hindrance from cable 42. According to some embodiments, the distance D is equal to or greater than the width of cover 112 to enable cover 112, if hinged to breaker box 32, to pivotably open for access to breaker box 32.

Embodiments of high mast lighting system 10 manufactured by providing a winch assembly 12 and securing winch assembly 12 to a pole plate 26 disposed within a mast 14 such that at least a portion of the winch assembly 12 is inserted within an opening 92 on pole plate 26. The method further comprises securing a breaker box 32 to the winch plate 28 and securing winch pate 28 to pole plate 26 such that at least a portion of the breaker box 32 is disposed within the opening 92 on pole plate 26.

Although embodiments of the winch assembly 12 have been described in detail, those skilled in the art will also recognize that various substitutions and modifications may be made without departing from the scope and spirit of the appended claims.

What is claimed is:

1. A high mast lighting system, comprising:

a mast;

a pole plate disposed within the mast; and a winch assembly housed within the mast and coupled to the pole plate, the winch assembly comprising a circuit breaker box, wherein at least a portion of the circuit breaker box is disposed through an opening in the pole plate.

2. The mast lighting system of claim 1, wherein the winch assembly comprises a spool for winding and unwinding a winch cable, wherein the winch cable is spaced apart from the circuit breaker box at least three (3) inches.

3. The mast lighting system of claim 1, wherein the winch assembly comprises a winch plate coupled to the pole plate.

4. The mast lighting system of claim 1, wherein the winch assembly comprises a winch plate directly coupled to the breaker box.

5. A mast lighting system, comprising:

a mast;

a pole plate disposed within the mast, the pole plate having a first surface and an opposed second surface; and a winch assembly housed within the mast and coupled to the pole plate first surface, wherein the winch assembly comprises a breaker box coupled thereto and extending through an opening of the pole plate so as to extend beyond the pole plate second surface.

6. The mast lighting system of claim 5, wherein the winch assembly comprises a winch plate coupled to the pole plate.

7. The mast lighting system of claim 5, wherein the winch assembly comprises a winch plate directly coupled to the breaker box.

8. A method of manufacturing a high mast lighting system, comprising:

providing a winch assembly having a breaker box and securing the breaker box to a winch plate;

securing the winch assembly to a pole plate disposed within a mast such that the winch assembly is housed within the mast, and at least a portion of the winch assembly is inserted within an opening on the pole plate.

9. The method of claim 8, further comprising securing the winch plate to the pole plate.

10. A high mast lighting system, comprising:

a mast;

a pole plate disposed within the mast;

a winch assembly housed within the mast, the winch assembly comprising a winch plate, a circuit breaker box and a drive system coupled to a winch plate, the drive system disposed at least partially in front of the circuit breaker box; and wherein the pole plate comprises an opening to enable the circuit breaker box to extend at least partially therethough when the winch plate is coupled to the pole plate such that the circuit breaker box is spaced apart from the drive system to provide access to the circuit breaker box.

11. The high mast lighting system of claim 10, wherein the drive system comprises a winch cable disposed in front of the circuit breaker box, the circuit breaker box positioned within the pole plate opening such that the breaker box is spaced apart from the winch cable a length equal or greater than the width of a cover on the breaker box.

12. The high mast lighting system of claim 10, wherein the drive system comprises an electric motor.

* * * * *